United States Patent [19]

Castonguay et al.

[11] 4,166,989

[45] Sep. 4, 1979

[54] CIRCUIT BREAKER REMOTE CLOSE AND CHARGED SIGNALLING APPARATUS

[75] Inventors: Roger N. Castonguay, Terryville; Charles L. Jencks, Avon, both of Conn.

[73] Assignee: General Electric Company, New York, N.Y.

[21] Appl. No.: 897,612

[22] Filed: Apr. 19, 1978

[51] Int. Cl.[2] ..... H01H 73/12; H01H 73/14

[52] U.S. Cl. ..... 335/17; 335/13; 340/638

[58] Field of Search ..... 335/17, 13; 200/308; 340/644, 638

[56] References Cited

U.S. PATENT DOCUMENTS

| | | | |
|---|---|---|---|
| 3,955,162 | 5/1976 | Nicol | 335/13 |
| 3,973,230 | 8/1976 | Ciarcia et al. | 335/17 |
| 4,056,816 | 11/1977 | Guim | 335/17 |
| 4,121,077 | 10/1978 | Mrenna et al. | 335/17 |
| 4,128,750 | 12/1978 | Castonguay et al. | 200/308 |

*Primary Examiner*—Harold Broome

*Attorney, Agent, or Firm*—Robert A. Cahill; Walter C. Bernkopf; Philip L. Schlamp

[57] ABSTRACT

A circuit breaker is provided with a hook operating to hold the breaker movable contacts open against the bias of charged mechanism springs. The hook is selectively actuated by a closing solenoid to release the contacts for abrupt closure under the urgence of the mechanism springs. An indicator is appropriately positioned under the joint control of the breaker mechanism and movable contacts to identify OFF, charged and ON breaker conditions and to, in turn, control an actuating lever for a switch operating in an external charged signalling and closing solenoid circuit.

10 Claims, 4 Drawing Figures

CIRCUIT BREAKER REMOTE CLOSE AND CHARGED SIGNALLING APPARATUS

BACKGROUND AND OBJECTS OF THE INVENTION

In certain applications it is necessary to coordinate or synchronize the closure of a circuit breaker with the functioning of other electrical apparatus, such as generators. With the typical industrial circuit breaker, charging of its mechanism springs preparatory to closure of its contacts is achieved by articulation of a manual operating handle. Normally, it is impossible to predict with any degree of precision when, after the mechanism springs have become fully charged, the mechanism has reached the condition where the springs can discharge pursuant to powering the breaker movable contacts to their closed circuit positions in engaging relation with the breaker stationary contacts. For the traditional toggle-type breaker operating mechanism, this condition is reached when, during mechanism articulation, the line of action of the mechanism springs moves from one side to the other side of a particular toggle pivot point.

To provide rather precise control of the moment of closure of breaker contacts, a hook has been used to hold the breaker movable contacts in their open positions against the bias of the mechanism springs, dispite the fact that the breaker mechanism has been articulated to its contact closure condition. When contact closure is desired, the hook is simply articulated to release the breaker movable contacts which then abruptly spring to their closed positions under the urgence of the mechanism springs. It is seen that in this arrangement, the circuit breaker has three stable conditions, that is, the circuit breaker may be not only open or closed, but also charged and ready to be closed. Since the breaker operating handle typically cannot distinctively indicate by its position each of these three breaker conditions, it is highly desirable to provide a separate indicator mechanism operable to unambiguously identify whether the breaker is open, closed or charged and ready to close. Commonly assigned, U.S. Pat. No. 4,042,896 discloses the utilization of a hook to hold breaker movable contacts open while the breaker mechanism is charged and indicator apparatus to identify these various conditions assumed by the circuit breaker.

It is a principle object of the present invention to provide simplified and cost-improved apparatus for signalling at a remote location when a circuit breaker operating mechanism is charged and for initiating closure of circuit breaker contacts from said remote location.

A further object of the present invention is to provide circuit breaker remote charged signalling and remote close apparatus of the above character which is inexpensive to manufacture, compact, and reliable in operation.

Other objects of the invention will in part be obvious and in part appear hereinafter.

SUMMARY OF THE INVENTION

In accordance with the present invention, there is provided apparatus for controlling the closure of circuit breaker contacts and for indicating the existing circuit breaker condition. More specifically, the apparatus of the present invention includes latching means for releaseably retaining the breaker movable contacts in their open circuit position, despite the fact that the breaker operating mechanism has been articulated to a condition calling for closure of the breaker contacts. That is, the mechanism springs have been charged, and the operating mechanism is in the condition where the mechanism springs would propel the movable contacts into engagement with the breaker stationary contacts, but for the restrain imposed on the movable contacts by the latching means. At the instant breaker closure is desired the latching means is actuated, either manually or electromechanically, to release the movable contacts, and the mechanism springs discharge to close the breaker.

To indicate the existing condition of the circuit breaker, the apparatus of the present invention further includes a pivotally mounted indicator arm carrying at one end a display panel bearing various breaker condition indicia. The other end of the indicator arm is coupled with the breaker movable contacts so as to sense whether they are open or closed. Also acting on the indicator arm is an actuator element coupled with the breaker operating mechanism to sense whether the mechanism springs are charged or discharged.

When the breaker contacts are open and the breaker mechanism is in its open circuit condition, i.e., the mechanism springs discharge, the indicator arm is angularly positioned by a return spring such as to register in a window provided in the breaker case display panel indicia indicating that the breaker is open or OFF. Then, upon articulation of the operating mechanism to charge the mechanism springs, the actuator element picks up the indicator arm, pivoting it to a new position where indicia on the display panel indicating the charged condition of the mechanism is registered with the window in the breaker case. Operatively coupled with the indicator arm is an actuating lever for a switch which operates when the indicator arm is in its breaker charged indicating position to condition the switch to complete an external circuit for a remotely located breaker charged signalling means and, coincidentally, to arm an external energization circuit for an internal closing solenoid operatively coupled with the breaker movable contact latching means.

When the closing solenoid is then energized, the latching means is operated to release the movable contacts; their movement into engagement with the stationary contact causing the indicator arm to be pivoted to still another position where the indicia ON borne by the display panel is registered in the case window. The switch actuating lever is repositioned under the control of the indicator arm to condition the switch so as to open the external breaker charged signalling circuit and to disarm the external closing solenoid energization circuit.

To open the circuit breaker, the operating mechanism is tripped, displacing the actuator element from the indicator arm. This, coupled with the opening movement of the breaker movable contacts and the bias of the return spring, returns indicator arm to its position where the display panel indicia OFF is again registered in the window. The switch actuating lever is left in its position of switch conditioning where the external breaker charged signalling circuit is open and the external closing solenoid energization circuit is disarmed.

The invention accordingly comprises the features of construction, combination of elements and arrangement of parts which will be exemplified in the construction hereinafter set forth, and the scope of the invention will be indicated in the claims.

For a fuller understanding of the nature and objects of the invention, reference should be had to the following detailed description taken in conjunction with the accompanying drawings, in which.

Like reference numerals refer to corresponding parts throughout the several views of the drawings.

DETAILED DESCRIPTION

The circuit breaker remote close and charged signalling apparatus of the present invention is particularly, but not exclusively applicable to circuit breakers having toggle operating mechanisms of the type illustrated in commonly assigned U.S. Pat. No. 4,001,742, the disclosure of which is specifically incorporated herein by reference. Reference is also made to commonly assigned, co-pending application, Ser. No. 881,269, filed Feb. 27, 1968, wherein the circuit breaker condition indicator apparatus seen in the instant drawings is disclosed and claimed.

Figure 1:
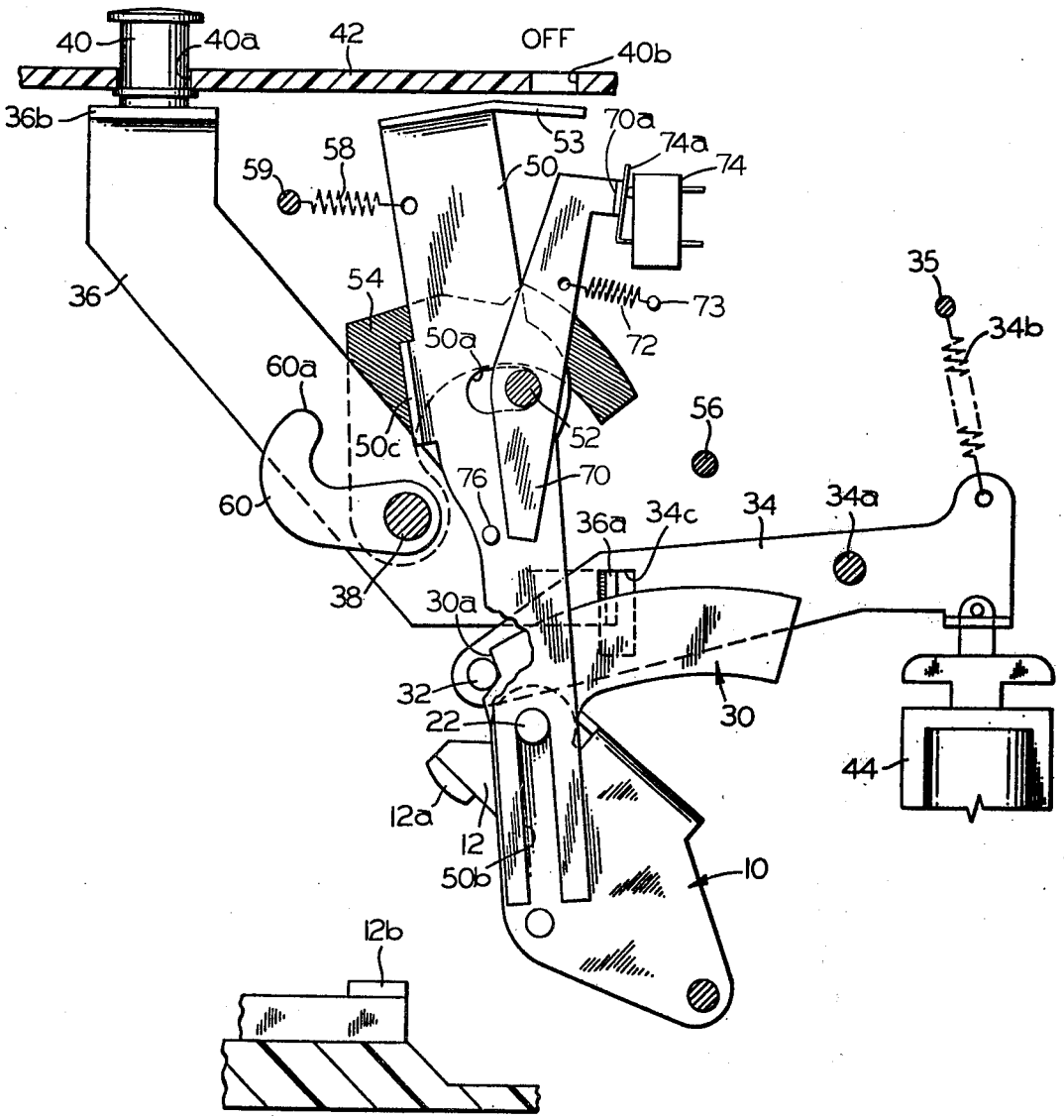
FIG. 1 is a side elevational view of the apparatus of the present invention, with its various parts illustrated in their positions assumed while the circuit breaker contacts are open and the breaker mechanism springs are discharged.

Turning to FIG. 1 herein, to provide control over the closure of the breaker contacts, a latch member, generally indicated at 30, is suitably affixed to a movable contact carrier 10. This latch member is provided with a latch shoulder 30*a* which is engaged by a latch pin 32 carried at the left end of a latch lever 34 pivotally mounted on a pin 34*a* carried by the breaker frame (not shown). A tension spring 34*b* anchored at one end to a stationary post 35 and hooked at its other end to the right end of latch lever 34 biases the latch lever in the counterclockwise direction so as to maintain latch pin 32 in engagement with latch shoulder 30*a*. To manually defeat this latching engagement, a close lever 36 is pivotally mounted intermediate its ends on a pin 38 journaled at its ends by the operating mechanism frame (not shown). The lower end of close lever 36 is provided with a laterally turned tab 36*a* which is engaged in an opening 34*c* formed in latch lever 34. The upper end of close lever 36 is provided with a laterally turned flange 36*b* poised for engagement by a close button 40 mounted in an opening 40*a* provided in a cover 42 of the circuit breaker case. It is seen that when pushbutton 40 is depressed, close lever 36 is pivoted in the counterclockwise direction about pin 38, causing its tab 36*a* to engage and lift latch lever 34 pursuant to disengaging latch pin 32 from latch shoulder 30*a*. If the breaker mechanism springs, seen in the above-noted U.S. Pat. No. 4,001,742 and co-pending application Ser. No. 881,269, have been charged, it is seen that with the disengagement of latch pin 32 from latch shoulder 30*a*, the movable contact carrier 10 is free to pivot downwardly under the urgence of the mechanism springs to achieve breaker contact closure.

Alternatively, breaker contact closure is effected by energization of a closing solenoid 44 whose plunger is operatively coupled to the right end of latch lever 34. It is seen that upon energization of this solenoid, its plunger is retracted to pivot latch lever 34 in the clockwise direction, thereby disengaging latch pin 32 from latch shoulder 30*a* pursuant to releasing contact carrier 10 for closure under the urgence of the charged mechanism springs.

To indicate the various conditions of the circuit breaker, there is provided an elongated indicator arm 50 which is jointly pivotally mounted by a pin 52, affixed to the mechanism frame and extending through a laterally elongated slot 50*a* in the indicator arm, and pin 22, affixed to carrier 10 and received in a longitudinally elongated, bottom opening notch 50*b* formed in the lower end portion of the indicator arm. The upper end of indicator arm 50 mounts a display panel 53 which bears various breaker condition indicia for individual registration with a window 40*b* in the breaker cover, depending upon the angular position of the indicator arm. Included with the breaker operating mechanism is a trigger or cradle 54 which is affixed on a pin 38 journaled by the operating mechanism frame. The cradle is shown in FIG. 1 in its tripped position with its latch shoulder 54*a* in disengaged relation to a trip latch pin 56 operatively controlled by the circuit breaker trip mechanism (not shown). Since in the situation depicted in FIG. 1 the breaker operating mechanism is in its tripped condition, the breaker movable contacts 12*a* are in their open circuit position with respect to stationary contacts 12*b* as illustrated. Under these circumstances, a return spring 58, anchored at one end at a stationary post 59 and hooked at its other end to the upper end of indicator arm 50, biases the indicator arm in the counterclockwise direction about pin 22 to an angular position determined by the abutment of pin 52 against the right end of slot 50*a* so as to register the indicia OFF borne by display panel 53 with window 40*b* in cover 42.

The condition indicator apparatus seen in FIG. 1 also includes, pursuant to the present invention, a switch actuator lever 70 which is pivotally mounted on post 52. A tension spring 72 anchored at one end to actuator lever 70 and at its other end to a stationary post 73 to bias the actuator lever in the clockwise direction and bring its laterally turned upper end portion 70*a* into actuating engagement with the actuating arm 74*a* of a normally closed switch 74. Thus, when actuatingly engaged by lever 70, in the breaker OFF condition seen in FIG. 1 switch 74 is open.

Figure 2:
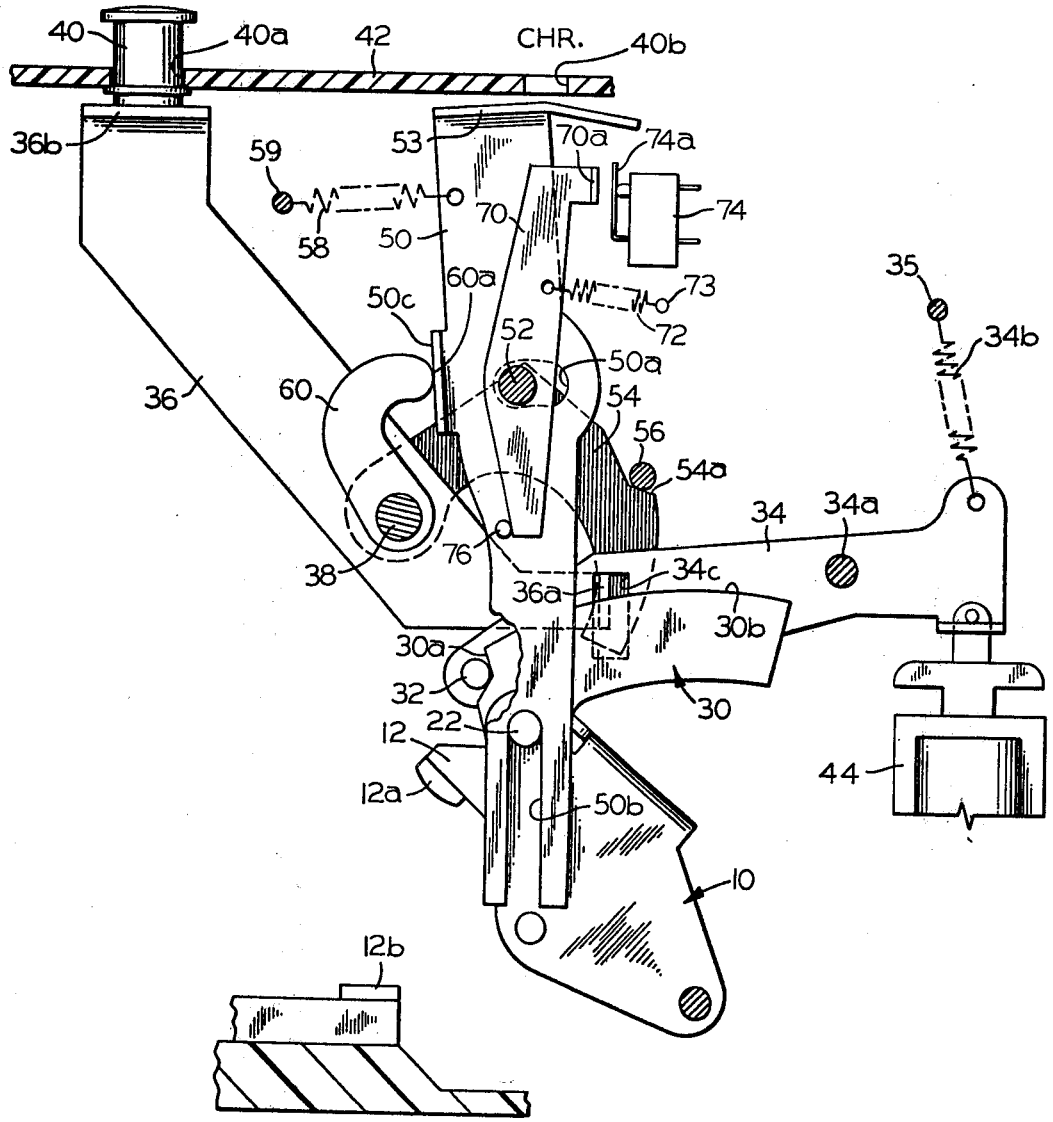
FIG. 2 is a side elevational view of the apparatus of FIG. 1, illustrating the position of its parts assumed when the breaker contacts are open and the mechanism spring are charged.

To reset the breaker operating mechanism and at the same time charge the mechanism springs, the operating mechanism is articulated by a suitable operating handle (not shown) in a manner to pivot cradle 54 about the axis of pin 38 in the clockwise direction around to the point where trip latch pin 56 can move into engaging relation with latch shoulder 54*a* of the cradle, as seen in FIG. 2. Affixed to post 38 and pivoting with cradle 54 during the resetting of the breaker operating mechanism is an actuating element 60. As the breaker operating mechanism is being reset, the nose 60*a* of this actuating element swings around in the clockwise direction into engagement with a laterally turned tab 50*c* carried by indicator arm 50. During the concluding increment of resetting motion of cradle 54, actuator 60 picks up and pivots indicator arm 50 about pin 22 in the clockwise direction (permitted by the lateral elongation of slot 50*a*) to an intermediate angular position where the indicia CHR on display panel 53 is registered with window 40*b*. This indicia, when viewable through window 40*b* identifies to the operator that the breaker operating mechanism is reset and the mechanism springs are charged. The breaker contacts cannot however close since latch lever pin 32 remains engaged with latch shoulder 30*a* of latch member 30 to hold movable contact carriers in their open circuit positions against the urgence of the charged mechanism springs.

Coincidentally with the pivotal movement of indicator arm 50 from its breaker OFF indicating position to its breaker charged indicating position, a pin 76, carried by the indicator arm, picks up the lower end of switch actuating lever 70 and pivots this lever in the counterclockwise direction to displace its upper end 70*a* from switch actuating arm 74*a*. With switch 74 de-actuated, it converts to its normally closed condition.

Figure 4:
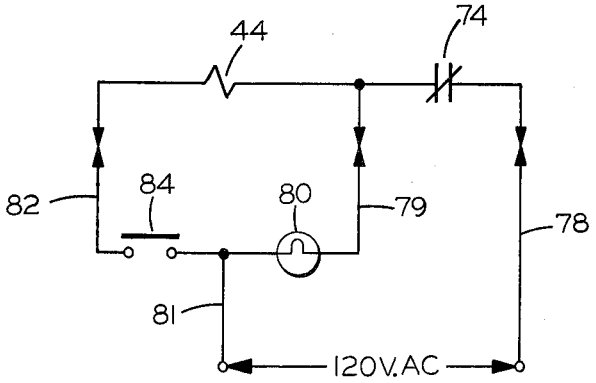
FIG. 4 is a wiring diagram for a combination breaker charged remote signalling and closing solenoid energization circuit utilized in conjunction with the apparatus of FIGS. 1-3.

Turning to the wiring diagram of FIG. 4, it is seen that one side of switch 74 is brought out by a lead 78 externally of the circuit breaker to one side of a suitable external voltage source, e.g., 120 VAC. The other side of this switch is connected to one side of closing solenoid 44, with the junction therebetween brought out via an external lead 79 to a remotely located signal lamp 80 and thence via lead 81 to the other side of the 120 VAC source. The other side of closing solenoid 44 is brought out via an external lead 82 to one side of a pushbutton switch 84, whose other side is connected in common with lamp 80 and lead 81 to the 120 VAC source. It is seen from FIG. 4 that switch 74 closes when the breaker operating mechanism is charged, and consequently lamp 80 is energized from the 120 VAC source through this switch to signal at its remote location, e.g., a control panel, that the breaker operating mechanism in indeed charged.

At the instant it is desired to effect closure of breaker contacts, latch lever 34 may be articulated by depression of close pushbutton 40 to disengage latch pin 32 from shoulder 30*a* of latch member 30, whereupon the mechanism springs are freed to partially discharge pursuant to straightening the mechanism toggle and thereby precipitating breaker contact closure. However, pursuant to the present invention, latch lever may be articulated to effect breaker contact closure by depression of remote pushbutton switch 84 to complete an external energization circuit for closing solenoid 44 from the 120 VAC source also through switch 74 which has closed to arm this energization circuit.

Figure 3:
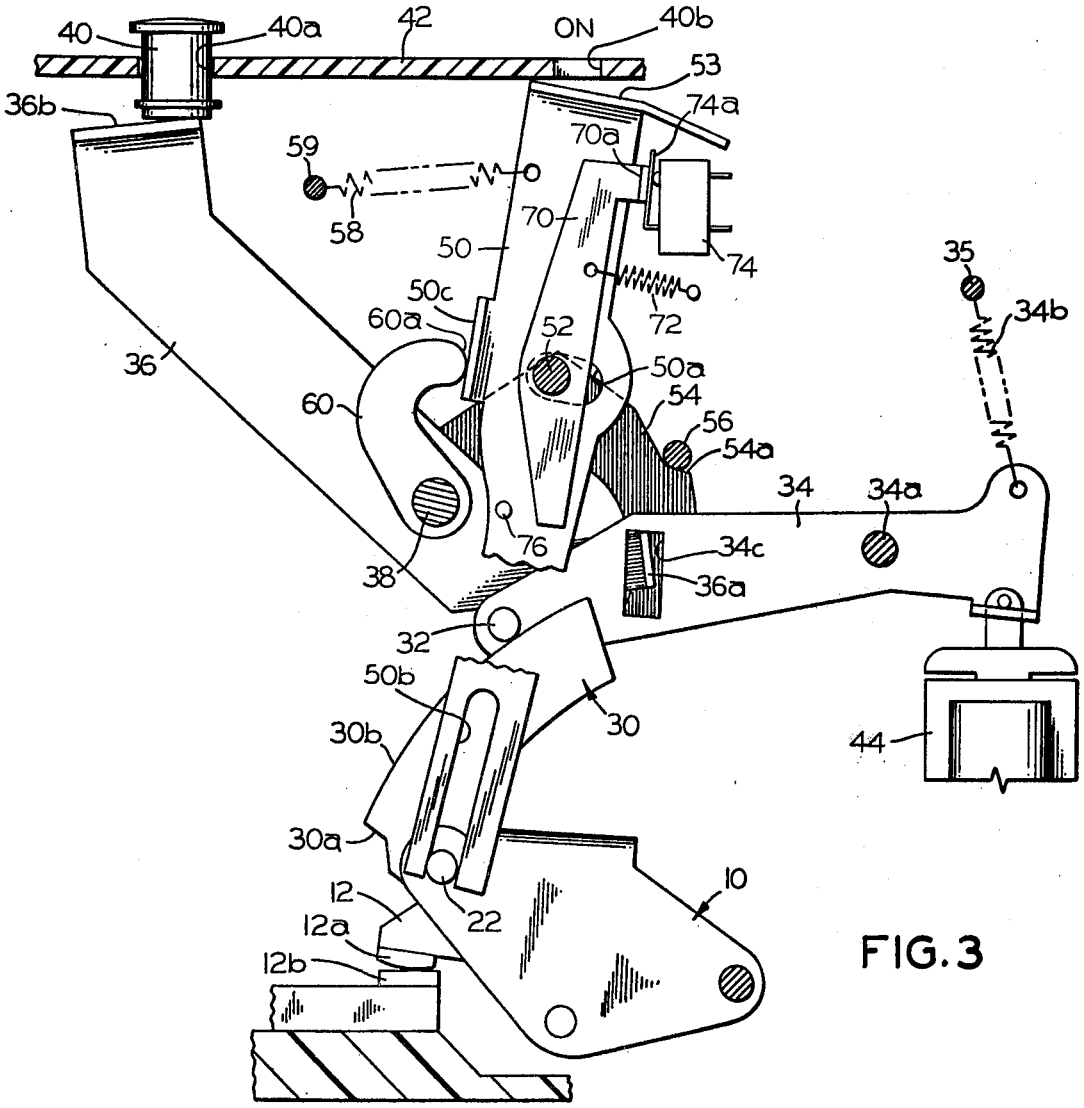
FIG. 3 is a side elevational view of the apparatus of the present invention, illustrating the positions of its various parts assumed when the breaker contacts are closed.

From FIG. 3 it is seen that with the closure of the breaker contacts, pin 22 of the movable contact carrier 10 rides downwardly in notch 50*b*, thereby, in effect, camming the lower end of indicator arm 50 to the left from its position seen in FIG. 2. This effectively shifts the pivotal mounting of indicator arm 50 from pivot pin 22 to a fulcrum created at the engagement of nose 60*a* of actuator element 60 with indicator arm tab 50*c*. The resulting pivotal movement of indicator arm 50 in the clockwise direction brings it to a third angular position where the indicia ON borne by display panel 53 is registered with window 50*b* in the breaker cover 42.

Coincidentally with movement of indicator arm 50 from its breaker charged to its breaker ON indicating positions, pin 76, carried thereby, releases switch actuating lever 70 and its return spring 72 pivots it in the clockwise direction, bringing its upper end 70*a* back into actuating engagement with switch actuating arm 74*a*. Switch 74 is thus converted back to its open condition, thereby opening the energization circuits for both charged signalling lamp 80 and closing solenoid 44. It will be noted that since switch 74 opens with the closure of the breaker contacts, needless sustained energization of the closing solenoid is automatically precluded. Consequently, this solenoid need be designed for limited duty only.

So as to maintain control over the position of latch pin 32 at the end of latch lever 34, latching member 30 is provided with an elongated arcuate edge 30*b* against which the latch pin rides under the bias of return tension spring 34*b* all the while movable contact carrier 10 is away from its open circuit position. When the carrier returns to its open circuit position, latch pin 32 rides along the arcuate edge 30*b* until latch shoulder 30*a* arrives, whereupon it drops down into latching engagement with the shoulder under the bias of return spring 34*b*.

To open the breaker contacts, the breaker operating mechanism is tripped by moving trip latch pin 56 out of engaging relation with the cradle latch shoulder 54*a*. The cradle is thus freed to swing on its pivot post 38 in the counterclockwise direction as the mechanism springs discharge. This shifts the line of action of the mechanism springs to a position where they can collapse the toggle, thereby swinging movable contact carrier 10 upwardly to its open circuit position. It is seen that with cradle 54 swinging in the counterclockwise direction, actuating element 60 is also swung counterclockwise out of engagement with indicator arm 50. At the same time, the opening movement of contact carrier 10 coupled with the action of return spring 58 swings the indicator arm 50 around to its position shown in FIG. 1 where pin 52 is bottomed against the right end of laterally elongated slot 50*a*, thereby establishing the angular position of the indicator arm where the indicia OFF on display panel 54 is again registered with window 40*b* in cover 42. It is seen that while indicator arm 50 is pivoted counterclockwise from its breaker ON to its breaker OFF indicating positions, pin 76 carried thereby does not engage switch actuating lever 70, leaving it in actuating engagement with switch actuating lever 74*a* to sustain switch 74 in its open condition.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. In a circuit breaker having an operating mechanism for translating movable contacts between open and closed circuit positions with respect to stationary contacts, apparatus for remotely controlling the closure of the movable contacts and for remotely signalling when the breaker operating mechanism is charged and ready to be closed, said apparatus comprising in combination:

A. latching means releaseably latching the movable contacts in their open circuit position against the force of a charged breaker operating mechanism acting to bias the movable contacts toward their closed circuit position;

B. a closing solenoid operable on said latch means to effect unlatching of the movable contacts, thereby enabling the charged operating mechanism to drive the movable contacts to their closed circuit position; and C. breaker condition indicating means including an indicator arm mounted for movement under the joint control of said movable contacts and the breaker operating mechanism between first, second and third positions to respectively identify when the circuit breaker is open, charged and ready to close, and closed;

D. a first switch situated internally of the circuit breaker;

E. an actuating lever controllably positioned by said indicator arm to selectively actuate said switch to its closed condition only when said indicator arm is in its second position identifying that the circuit breaker is charged and ready to be closed;

F. signalling means located externally of the circuit breaker;

G. a second switch located externally of the circuit breaker; and

H. external wiring interconnecting said first and second switches, said closing solenoid and said signalling means with a voltage source, whereby closure of said first switch completes an energization circuit for said signalling means and arms an energization circuit for said closing solenoid preparatory to its completion by closure of said second switch.

2. The apparatus defined in claim 1, wherein said indicator arm is mounted for pivotal movement between said first, second and third positions in succession.

3. The apparatus defined in claim 2, wherein said switch actuating lever is mounted for pivotal movement relative to said first switch.

4. The apparatus defined in claim 3, wherein said first switch is a normally closed switch.

5. The apparatus defined in claim 4, which further includes a spring normally biasing said actuating lever into actuating engagement with said first switch to convert same to its open condition.

6. The apparatus defined in claim 5, wherein said indicator arm carries means engaging said actuating lever to pivot it against the bias of said spring to a position deactivating said first switch to its normally closed condition only when said indicator arm is in its second position.

7. The apparatus defined in claim 6, which further includes an actuator element coupled with the breaker operating mechanism for movement therewith incident to charging the operating mechanism, said actuator element, in the process, engaging and pivoting said indicator arm from its first position to its second position.

8. The apparatus defined in claim 7, wherein a transversely elongated first slot is formed in said indicator arm intermediate its ends, a stationary first post received through said first slot, and a longitudinally elongated slot is formed in said other end of said indicator arm, and a second post carried by the movable contacts is received through said second slot, whereby said indicator arm pivots on said second post when shifted from said first position to said second position by said actuator element and pivots on a fulcrum located at the point of engagement of said actuator element with said indicator arm when shifted from said second position to said third position by the translation of the movable contacts from their open circuit position to their closed circuit position.

9. The apparatus defined in claim 8, wherein said switch actuating lever is pivotally mounted on said first post.

10. The apparatus defined in claim 9, wherein said indicator arm carries a display panel bearing plural distinct breaker condition indicia for separate registration in a viewing window depending on the position of said indicator arm.

* * * * *